United States Patent [19]

Lin et al.

[11] 4,445,104

[45] Apr. 24, 1984

[54] COMPACT STEP-LAP MAGNETIC CORE

[75] Inventors: Kou C. Lin, Hermitage; Charles E. Burkhardt, Sharon, both of Pa.

[73] Assignee: Electric Power Research Institute, Inc., Palo Alto, Calif.

[21] Appl. No.: 212,581

[22] Filed: Dec. 3, 1980

[51] Int. Cl.[3] ..... H01F 27/24; H01F 41/02

[52] U.S. Cl. ..... 336/217; 29/609

[58] Field of Search ..... 336/216, 217, 234, 212; 29/607, 608, 609

[56] References Cited

U.S. PATENT DOCUMENTS

| | | | |
|---|---|---|---|
| 2,300,964 | 11/1942 | Putman | 336/217 |
| 2,393,038 | 1/1946 | Forbes | 336/217 |
| 2,407,625 | 9/1946 | Brand | 336/217 X |
| 2,972,804 | 2/1961 | Ellis | 336/217 X |
| 2,973,494 | 2/1961 | Ellis | 336/217 |
| 3,064,220 | 11/1962 | Specht | 336/217 |
| 3,069,643 | 12/1962 | Stein et al. | 336/217 |
| 3,153,215 | 10/1964 | Burkhardt et al. | 336/217 |
| 3,283,281 | 11/1966 | Stein et al. | 336/216 X |
| 3,303,448 | 2/1967 | Farry | 336/217 X |
| 3,611,234 | 10/1971 | De Laurentis et al. | 336/217 |

FOREIGN PATENT DOCUMENTS

| | | | |
|---|---|---|---|
| 579467 | 8/1946 | United Kingdom | 336/217 |

OTHER PUBLICATIONS

"Progress of Core Technology in Transformer Manufacturing", K. C. Lin and B. B. Ellis, Insulation/Circuits, Dec. 1977.

*Primary Examiner*—Thomas J. Kozma

*Attorney, Agent, or Firm*—Flehr, Hohbach, Test, Albritton & Herbert

[57] ABSTRACT

A magnetic core including a plurality of layers of laminations formed from a magnetic strip material wherein at least two side leg and two yoke laminations are assembled around a core window to form four outer corners. Each of the side leg and yoke laminations have had one end thereof sheared diagonally with respect to the longitudinal dimension of the strip material. The other half of this one end is sheared substantially perpendicular to the strip material's longitudinal dimension. In each layer, the ends of the side leg and yoke laminations form two joints that are half straight and half diagonal. The ends of the side leg and yoke laminations in each layer form a step pattern about the outer corners of the core with the joints between the side leg and yoke laminations in one layer overlapping the joints between the side leg and yoke laminations in the next adjacent layer. A series of lap joints is thus formed in step relation.

38 Claims, 17 Drawing Figures

COMPACT STEP-LAP MAGNETIC CORE

The present invention relates generally to magnetic core structures for use in electrical induction apparatus, and more particularly to the construction of a step-lap type transformer core.

In certain types of electrical inductive apparatus, such as transformers, a magnetic core structure is provided which includes a plurality of stacked layers of laminations formed from a magnetic strip material. One common way to make such cores is to use a magnetic strip material having a preferred direction of orientation parallel to the longitudinal dimension of the material, for example, a non-amorphous material such as grain-oriented silicon steel.

In order to obtain more efficient joints between the laminations, transformer cores made from oriented material often employ butt-lap joints. The butt-lap joints are located adjacent to the corners of the core structure in which the adjoining edges of the core laminations are cut at an angle to the direction of the strip material. This gives a higher permability for the core structure and lower losses in the core structure. An example of a core using the butt-lap joint configuration is shown in U.S. Pat. No. 2,300,964, issued Nov. 3, 1942.

Another type of transformer core used in stacking laminations made of oriented magnetic strip material is one having a step-lap joint configuration. The step-lap core may have miter cut leg and yoke laminations arranged in step relation in successive layers to form a stepped pattern at the outer corners of the core. The step-lap core has lower exciting current requirements and lower core losses than does the butt-lap core. Cores of the step-lap type are described in U.S. Pat. No. 3,153,215, issued Oct. 13, 1964 and U.S. Pat. No. 2,973,494, issued Feb. 28, 1961.

Although the butt-lap and step-lap cores are widely used, the miter cut joint configuration does present certain problems. For instance, in both the butt-lap and step-lap configurations, the amount that the joint between adjoining laminations is overlapped by the next layer of laminations is relatively small. This reduces the mechanical strength of the joint which makes the core less able to resist short circuit forces. Also in both types of cores, air gaps may be present at joints or the laminations may be misaligned because of the narrow step overlap. This will produce higher core losses. In the step-lap configuration, inner and outer voids may exist between the layers of laminations, disrupting the magnetic flux paths. Also the laminations in the step-lap core may have portions that form projections which disrupt the flux paths.

The present invention is directed to a unique construction of a step-lap magnetic core which is an improved design over prior core designs in that the core contains no inner and outer voids between laminations and no protruding projections. In this respect, the core of the present invention may be thought of as a compact step-lap core. The core of the present invention also provides a wide overlap between joints in successive layers of laminations to thereby increase the mechanical strength of the core. The core of the present invention also permits scrapless construction in certain embodiments.

An object of the present invention is to provide a new and improved magnetic core for electrical induction apparatus.

Another object of the present invention is to provide a new and improved step-lap type magnetic transformer core including a plurality of stacked layers of laminations formed from a magnetic strip material.

The magnetic core of the present invention includes a plurality of layers of laminations formed from a magnetic strip material wherein at least two side leg and two yoke laminations are assembled around a core window to form four outer corners. Each of the side leg and yoke laminations have half of one end thereof sheared diagonally with respect to the longitudinal dimension of the strip material. The other half of this one end is sheared substantially perpendicular to the longitudinal dimension of the strip material. In each layer, the ends of the side leg and yoke laminations form two joints that are half straight and half diagonal. The ends of successive layers of the side leg and yoke laminations are arranged in step relation to form a step pattern about the outer corners of the core. The ends of the side leg and yoke laminations in one layer overlap the ends of the side leg and yoke laminations in the next adjacent layer to present a step-lap joint joining the ends of the side leg and yoke laminations.

The magnetic core of the present invention is described in more detail in conjunction with the drawings wherein:

FIG. 1 is an isometric view of a magnetic core illustrating a first embodiment of the present invention;

FIG. 1*a* is a plan view of FIG. 1 illustrating the location of the joints formed between the laminations in successive layers of the magnetic core;

Figure 4:
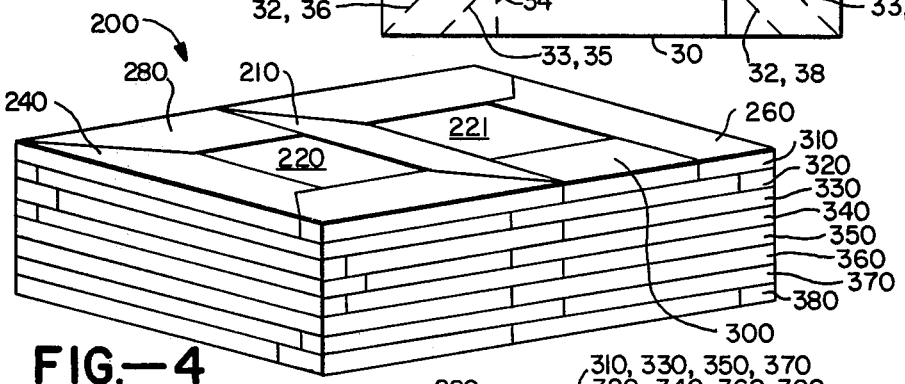
FIG. 4 is an isometric view of a magnetic core structure illustrating a second embodiment of the present invention.
Figure 4A:
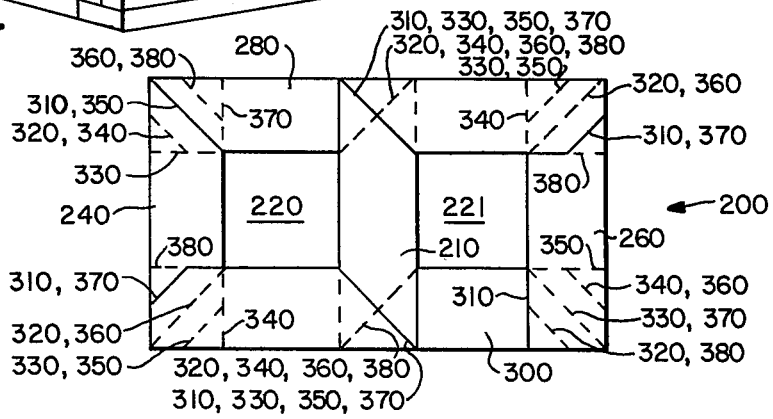
Figure 5:
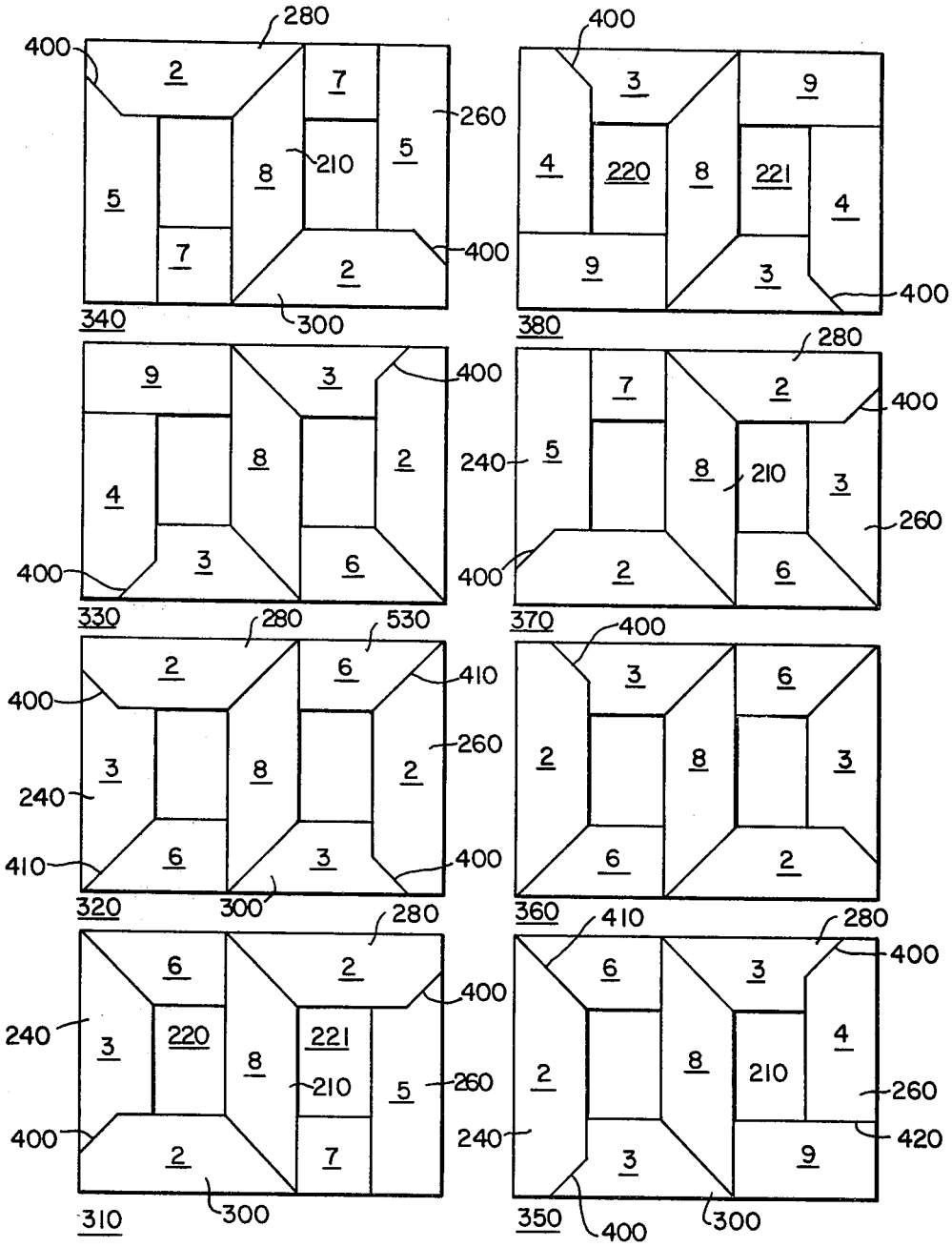
Figure 6:
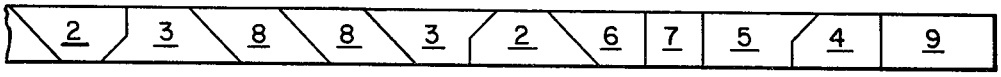
Figure 7:
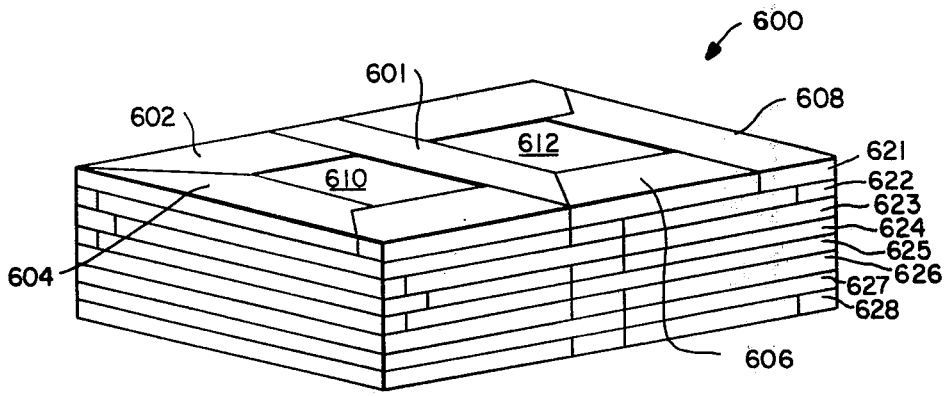
Figure 7A:
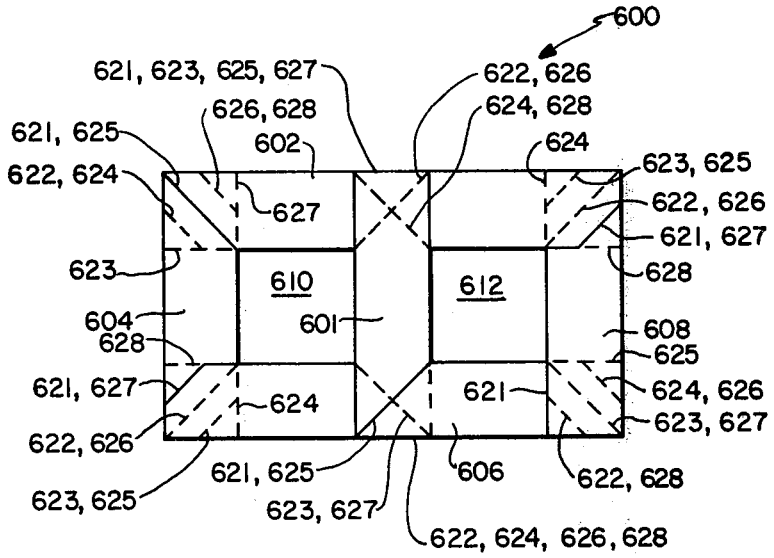
Figure 8:
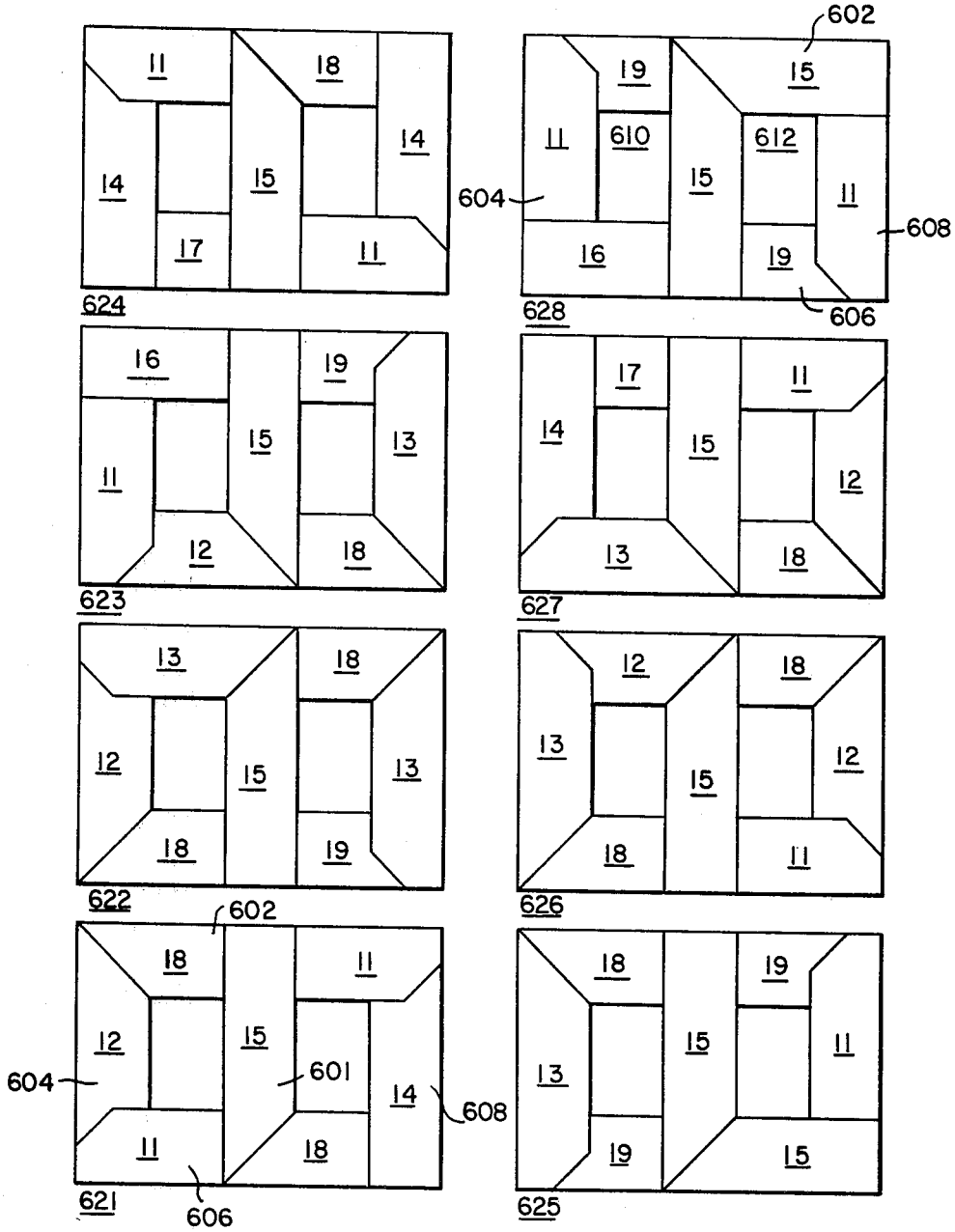
Figure 9:
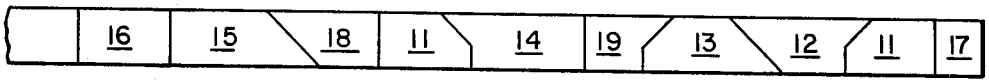
Figure 10:
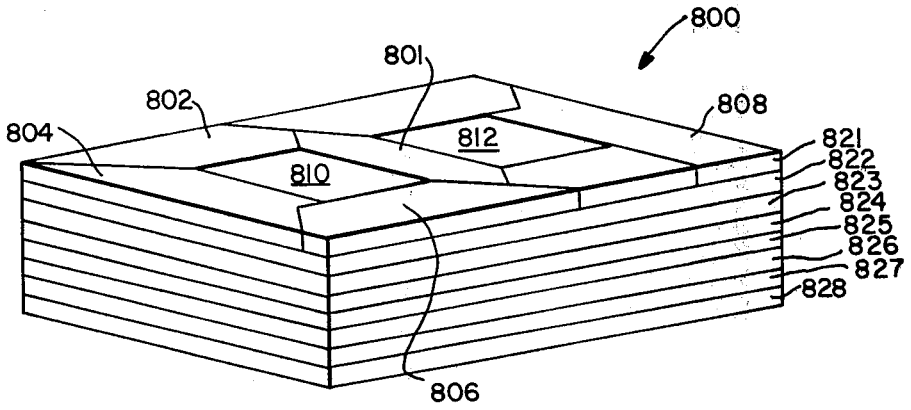
Figure 10A:
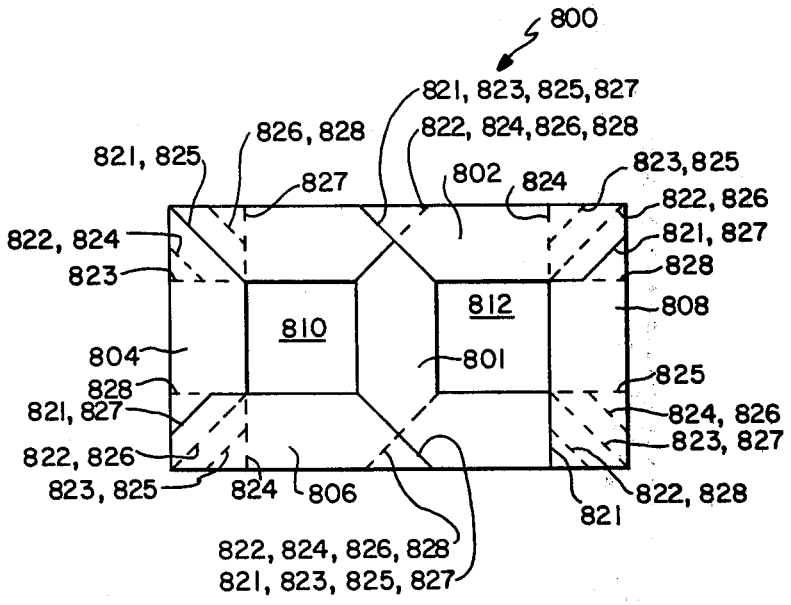

FIG. 4*a* is a plan view of FIG. 4 illustrating the location of the joints formed between the laminations in successive layers of the magnetic core;

FIG. 5 illustrates parts of the magnetic core structure shown in FIG. 4;

FIG. 6 illustrates the punching sequence for the laminations of the magnetic core structure shown in FIG. 4;

FIG. 7 is an isometric view of a magnetic core structure illustrating a third embodiment of the present invention;

FIG. 7*a* is a plan view of FIG. 7 illustrating the location of the joints formed between the laminations in successive layers of the magnetic core;

FIG. 8 illustrates the parts of the magnetic core structure shown in FIG. 7;

FIG. 9 illustrates the punching sequence for the laminations of the magnetic core structure shown in FIG. 7;

FIG. 10 is an isometric view of a magnetic core structure illustrating a fourth embodiment of the present invention;

FIG. 10*a* is a plan view of FIG. 10 illustrating the location of the joints formed between the laminations in successive layers of the magnetic core.

Figure 11:
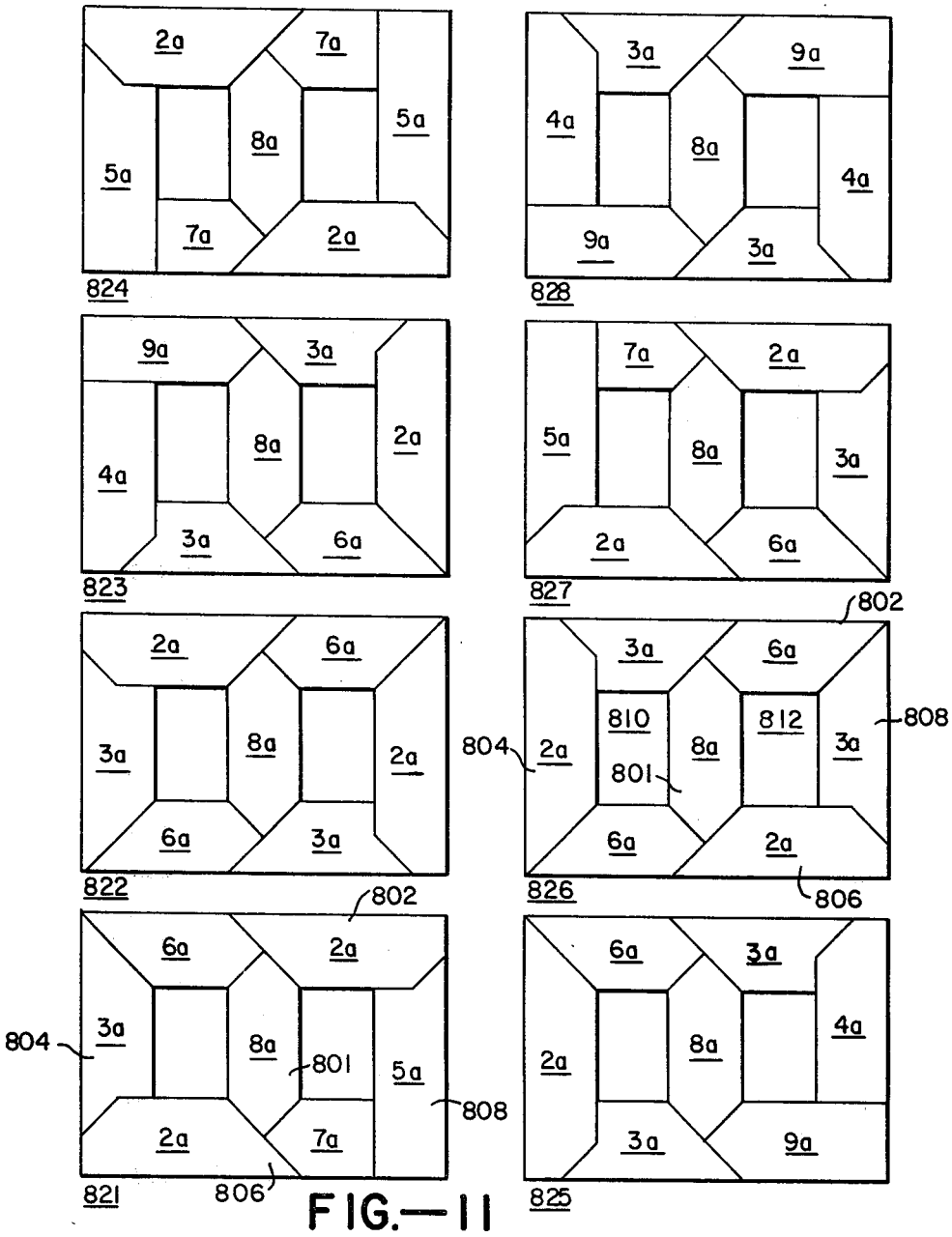
Figure 12A:
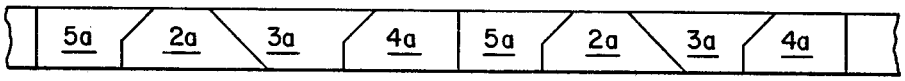
Figure 12B:
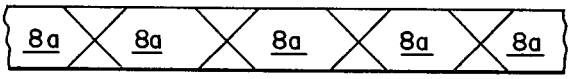

FIG. 11 illustrates parts of the magnetic core structure shown in FIG. 10; and FIGS. 12*a* and 12*b* illustrate the punching sequence for the laminations of the magnetic core structure shown in FIG. 10.

Figure 1:
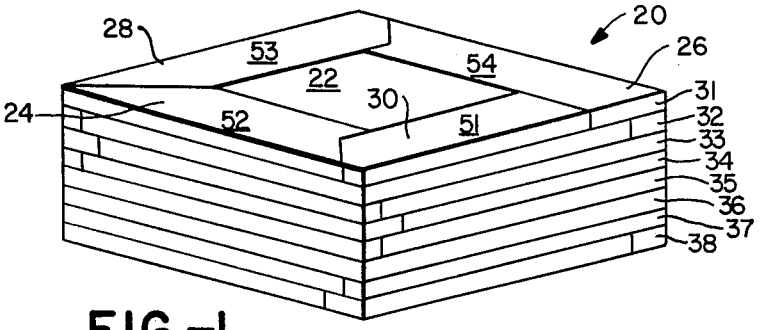
Figure 2:
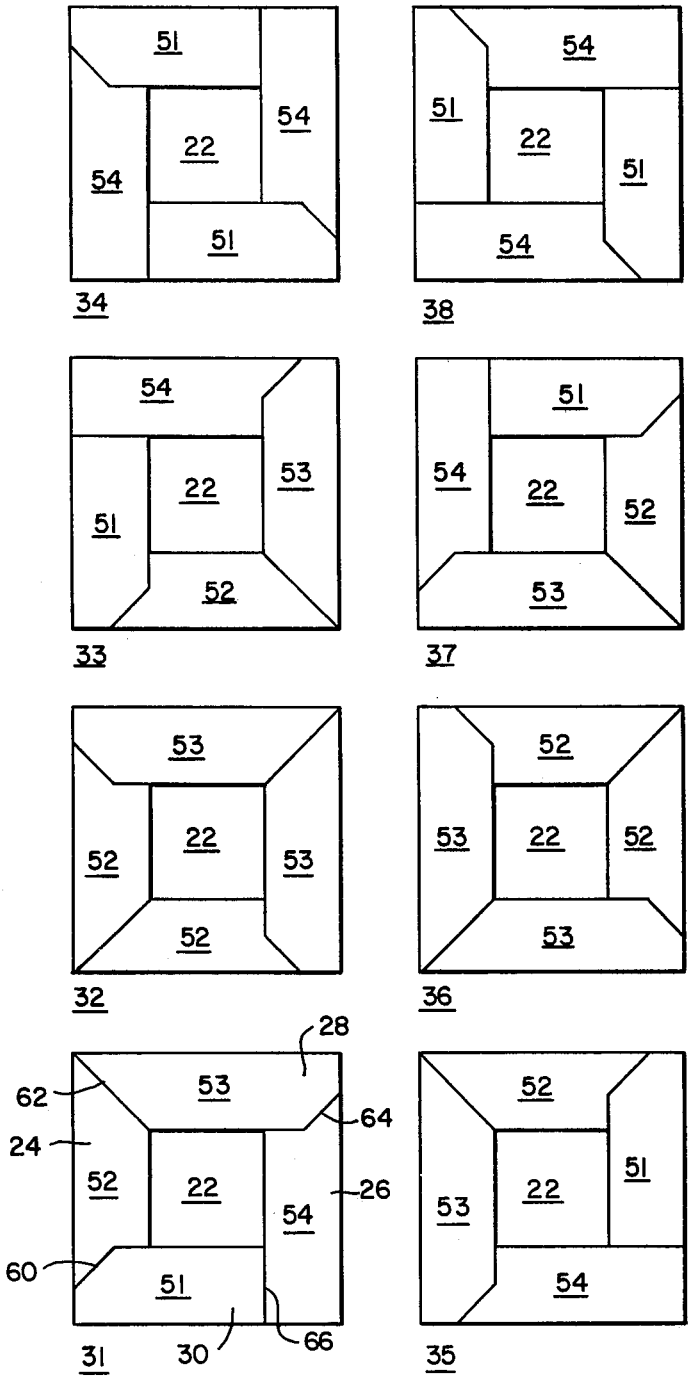
FIG. 2 illustrates parts of the magnetic core structure shown in FIG. 1.
Figure 3:
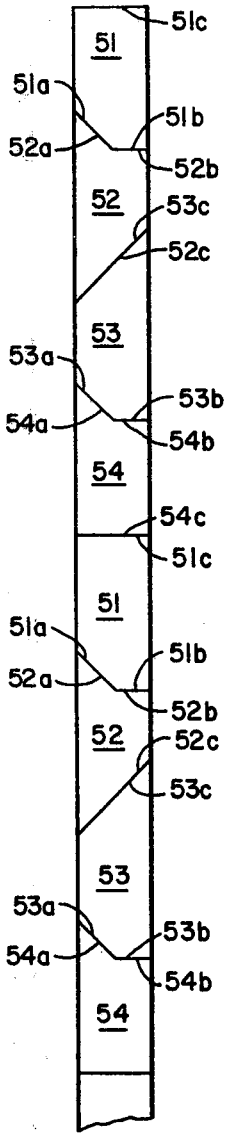
FIG. 3 illustrates the punching sequence for the laminations of the magnetic core structure shown in FIG. 1.

Referring now to the drawings, in which like components are designated by like reference numbers throughout the various figures, attention is first directed to FIGS. 1 through 3. FIG. 1 shows a stacked magnetic core 20 which is especially suitable for use in a single phase transformer or like electrical induction apparatus. Core 20 is comprised of a plurality of stacked layers of laminations assembled to form a substantially square core, having a substantially square window 22. Of course, the laminations of core 20 may be stacked in any appropriate shape; for example, the laminations may be stacked to form a substantially rectangular core having a substantially rectangular window. As is well known in the art, core 20 may be stacked by any appropriate method used in stacking transformer cores.

The laminations of core 20 are formed from a magnetic strip material. The magnetic strip material may be a material that has a preferred direction of orientation parallel to the longitudinal direction of the material, for example, a grain-oriented silicon steel. The layers of laminations of core 20 may alternately be formed from a magnetic strip material that is unoriented, as non-grain orientated steel.

The laminations of core 20 may also be formed from an amorphous strip material, for example, METGLAS amorphous metal strip material manufactured by the Allied Chemical Company.

Each layer of laminations of core 20 includes at least two yoke laminations and two side leg laminations assembled with the adjoining ends of the laminations substantially aligned to form joints therebetween. Particularly, core 20 includes side legs 24 and 26, an upper yoke 28, and a lower yoke 30. As shown in FIG. 1, the core comprises a plurality of layers 31 through 38. Each of these layers includes upper and lower yoke laminations and first and second side leg laminations. For example, as shown in FIGS. 1 and 2, layer 31 includes laminations 51 and 53 which form the lower and upper yoke laminations, respectively. Layer 31 further includes laminations 52 and 54 which form the side leg laminations 24 and 26, respectively.

From FIGS. 2 and 3, it can be seen that each layer of core 20 comprises four laminations selected from the group of laminations 51, 52, 53, and 54. The arrangement of laminations 51–54 in layers 31–38 is different in each layer. If transformer core 20 is to have more than eight layers, the arrangement of the laminations in the ninth layer on up to the desired number of layers will be repeated, following the pattern of layers 31–38. Thus, the arrangement of the laminations in a ninth layer would be the same as that as layer 31. The arrangement of the laminations in a tenth layer would be the same as that in layer 32 and so on. In this sense, the layers of laminations of the magnetic core are divided into groups, each containing eight layers. As indicated, the core may be constructed of any number of layers desired. It may be formed of one or more groups of layers or less than one group. Preferably, the core will contain at least three layers of laminations.

Each of the laminations 51–54 have half of one end thereof sheared diagonally with respect to the longitudinal dimension of the strip material that forms the laminations. Preferably, this half of one end is sheared at an angle of approximately 45°, as indicated at 51*a* of lamination 51, 52*a* of lamination 52, 53*a* of lamination 53, and 54*a* of lamination 54. The other half of this one end of the laminations is sheared substantially perpendicular to the longitudinal dimension of the strip material forming the lamination. This half is indicated at 51*b* of lamination 51, 52*b* of lamination 52, 53*b* of lamination 53, and 54*b* of lamination 54. The opposite ends 51*c* and 54*c* of laminations 51 and 54, respectively, are cut, sheared, or punched substantially perpendicular to the longitudinal dimension of the strip material that forms the lamination. The opposite ends 52*c* and 53*c* of laminations 52 and 53, respectively, are sheared substantially diagonally, preferably at an angle of 45°, to the longitudinal dimension of the magnetic strip material.

The arrangement of the laminations in each layer of stacked core 20 is shown in FIG. 2. As shown, the ends between the laminations are aligned to form joints therebetween. In layer 31, the joint 60 between laminations 51 and 52 comprises a half straight and half diagonal joint formed by the respective ends of laminations 51 and 52. The joint 62 between laminations 53 and 52 is a diagonal joint. The joint 64 between laminations 53 and 54 is the half straight and half diagonal joint. And the joint 66 between laminations 51 and 54 is a straight joint, which is at an angle of 90° to the longitudinal dimension of the magnetic strip material.

The laminations are stacked in each layer so that the two half-straight and half-diagonal joints are on diagonally opposite sides of core window 22 in each successive layer. In stacking the laminations in each layer, the half straight and half diagonal joints are shifted 90° in each successive layer. For instance, the half-straight and half-diagonal joint in the lower left-hand corner of layer 31 is shifted to the upper left-hand corner in layer 32 to form a half straight and half diagonal joint there. Likewise, the half straight and half diagonal joint in the upper right-hand corner of layer 31 is shifted to the lower right-hand corner in layer 32.

Figure 1A:
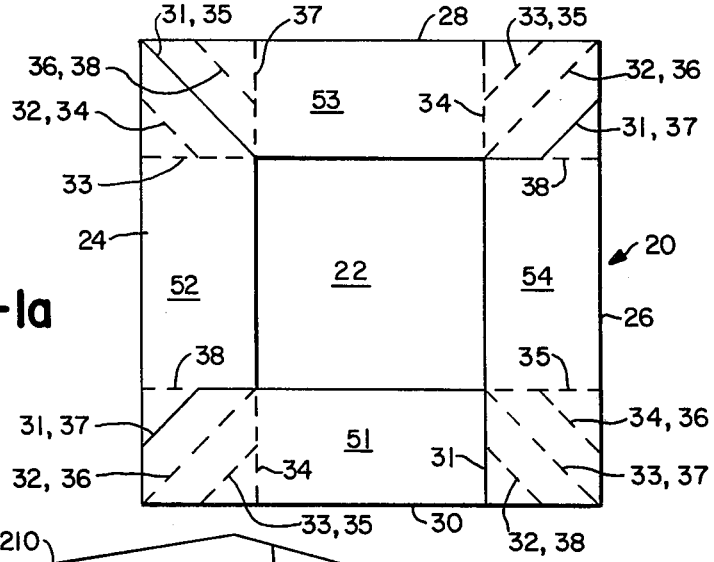

Now referring to FIGS. 1, 1*a*, which shows the location of the joints in each layer, and 2, the layers of core 20 are shown as stacked with the ends of the laminations arranged in step relation with respect to the ends of the corresponding laminations in the next adjacent layer. The joint between the side leg and yoke laminations is offset or staggered relative to the corresponding joint, about the same corner of the core, in the next adjacent layer. Accordingly, the ends of the laminations in each layer form a step pattern about the outer corners of the core. The joints between the side leg and yoke laminations in one layer lap those in the next adjacent layer. Core 20 thus includes a series of lap joints between the laminations, the joints included in the layers being arranged in step relation.

Laminations 51–54 are arranged in layers 31–38 so that the ends of the laminations in successive layers are arranged in step relation, the ends of the laminations in one layer overlapping the corresponding ends of the laminations in the next adjacent layer. For instance, the joint between laminations 51 and 52 in layer 31 is overlapped by the joint between laminations 52 and 52 in layer 32. The step pattern formed by the joints between the laminations in each layer is illustrated in FIG. 1*a*.

The ends of the laminations in one layer should overlap in the corresponding lamination ends in the next layer by a substantial amount. It has been found in practice that excellent results are obtained in step-lap cores where the lamination ends overlap the joints in the next adjacent layer to the extent of about six times the thickness of the lamination.

Referring to FIG. 3, it is seen how the laminations 51 through 54 may be punched from a magnetic strip material without producing scrap. As opposed to some prior step-lap core designs, the core of the present invention does not require that incremental clips be made in the core laminations.

It should be understood that the magnetic core constructed as disclosed in FIGS. 1 through 3 may also include center leg laminations so that the core may function as a three-phase transformer core. FIGS. 4 through 5 illustrate a core 200 with a center leg 210. Three-phase core 200 also includes side legs 240 and 260, an upper yoke 280, and a lower yoke 300. Core 200 comprises a plurality of stacked layers of laminations assembled to form a substantially rectangular core, having in this particular case two substantially rectangular windows 220 and 221.

The core comprises a plurality of layers 310 through 380. Each of these layers includes upper and lower yoke laminations, a center leg lamination, and first and second side or outer leg laminations. The adjoining ends of the laminations in each layer are substantially aligned to form joints therebetween. Like core 20, the arrangement of the laminations is different in each layer with the arrangement pattern repeating itself every eight layers. That is, if there is to be a ninth layer in core 200, the laminations that comprise the ninth layer will have the same pattern as those in layer 310.

As seen from FIG. 5, side leg laminations 240 and 260 in layer 310 are made from lamination pieces 3 and 5, respectively. Center leg lamination 210 is made from lamination piece 8. Lower yoke lamination 300 is made of two lamination pieces 2 and 7, and upper yoke lamination 280 is made of two lamination pieces 2 and 6. Both the upper and lower yoke laminations of core 200 include a recess appropriately configured to receive the respective right-triangle shaped ends of the center leg laminations. As illustrated, this recess is formed between the two pieces of laminations 2 and 6 in the upper yoke lamination. Likewise, the two lamination pieces 2 and 7 form the appropriate recess in the lower yoke lamination.

The upper and lower yoke laminations in each layer of core 200 are formed of two pieces in order that the laminations may be formed, as shown in FIG. 6, by punching or shearing the magnetic strip material without producing scrap. It is understood, of course, that both the lower and upper yoke laminations in each layer may also be made of one lamination piece. In this case, the respective substantially right-triangle shaped recesses are cut into both the upper and lower yoke laminations.

As with core 20, each layer of laminations in core 200 includes a half straight and half diagonal joint formed between the upper and lower yoke laminations and the side leg laminations. These half straight and half diagonal joints are shown at 400 in FIG. 5. Like core 20, two of these joints are located in each layer of the core on diagonally opposite sides of the core. For instance, in layer 320, joint 400 between side leg lamination 240 and upper yoke lamination 280 is formed by the ends of lamination pieces 2 and 3. As illustrated in FIG. 6, the appropriate ends of lamination pieces 2 and 3 are punched to form a half straight and half diagonal end. And like core 20, in stacking the laminations in each layer, the half straight and half diagonal joints are shifted 90° in each successive layer. For instance, joint 400 in the upper left-hand corner of layer 360 is shifted to the upper right-hand corner in layer 370. Likewise, joint 400 in the lower right-hand corner of layer 360 is shifted to the lower left-hand corner in layer 370.

The other joints in each layer between the side leg and yoke laminations, as with core 20, is either a straight or diagonally cut joint. As shown in FIG. 5, layer 320 includes two diagonal joints at 410. Layer 350 includes a diagonal joint 410 between side leg lamination 240 and upper yoke lamination 280, and layer 350 includes a straight joint 420 between side leg lamination 260 and upper yoke lamination 280.

Referring to FIGS. 4, 4*a* and 5, the layers of laminations in core 200 are stacked like core 20 to form a series of lap joints in step relation. That is, the layers of core 200 are stacked with the ends of the side leg and yoke laminations arranged in a step relation about the outer corners of the core with respect to the ends of the corresponding laminations in adjacent layers. And the joints between the side leg and yoke laminations in one layer overlap the joints between the the laminations in the next adjacent layer.

Another embodiment of the magnetic core of the present invention which may be used in a the three-phase transformer core is shown in FIGS. 7 through 9. Core 600 is similar in construction to core 200. It comprises side leg laminations 604 and 608, center leg laminations 601, and upper and lower yoke laminations 602 and 606, respectively. Core 600 is constructed of a plurality of stacked layers 621 through 628 of laminations assembled around two substantially rectangular core windows 610 and 612. The adjoining ends of the laminations in each layer are substantially aligned to form joints therebetween.

Core 600 differs from core 200 in that its center leg laminations 601 has a different configuration. Particularly, one end of center leg laminations 601 has a substantially square shape with the other end being substantially in the shape of a right triangle.

As seen in FIG. 7, the yoke laminations of core 600 are each made from two lamination pieces, each yoke lamination including an appropriately configured recess for receiving the respective ends of the center leg laminations. A scrapless punching sequence for the laminations of core 600 is shown in FIG. 9. Of course, as with core 200, the yoke laminations may be made from a single lamination piece wherein they contain respective substantially right triangle and square shaped recesses to receive the ends of the center leg laminations. In either configuration the side leg and yoke laminations in each layer are arranged so that the ends of the laminations in one layer are in step relation with respect to the ends of the corresponding laminations in the adjacent layers, the joints between the ends of the laminations overlapping those in the next adjacent layer.

Yet another embodiment for a three-phase transformer core is shown is FIGS. 10 through 12*b*. Core 800 is similar to the above-described cores. It comprises side leg laminations 804 and 808, center leg laminations 801, and yoke laminations 802 and 806. A plurality of stacked layers 821 through 828 of laminations are assembled to form a substantially rectangular core, having two substantially rectangular windows 810 and 812.

As with the cores of the other embodiments, the ends of the side leg and yoke laminations in each layer of core 800 form a step pattern about the outer corners of the core with the joints between the laminations in one layer overlapping the joints between the laminations in the next adjacent layer. A series of lap joints are thus formed in step relation as shown in FIGS. 10, 10*a* and 11.

The punching sequence for the laminations of core 800 is shown in FIGS. 12*a* and 12*b*. In this embodiment, as center leg lamination 801 has two substantially V-shaped ends, the punching is not scrapless. The yoke laminations, as with the other cores, may be formed from either two lamination pieces as illustrated or from a single lamination piece. In either embodiment, the yoke laminations of core 800 include appropriate V-shaped recesses for receiving the the respective ends of the center leg laminations.

Lamination pieces 2*a*, 3*a*, 4*a*, and 5*a* can be sheared as shown in FIG. 12*a*. Lamination piece 6*a* can be cut from lamination piece 5*a*, and lamination pieces 7*a* and 9*a* can be made from lamination piece 4*a*. Lamination piece 8*a* can be made from a separate shear operation as shown in FIG. 12*b*.

Although certain specific embodiments of the invention have been described herein in detail, the invention is not to be limited to only such embodiments, but rather only by the appended claims.

What is claimed is:

1. A stacked magnetic core comprising:

a plurality of layers of laminations formed from a magnetic strip material, each of said layers including at least two side leg and two yoke laminations assembled around a core window forming four outer corners, each of said side leg and yoke laminations having a half of one end thereof sheared diagonally with respect to the longitudinal dimension of said strip material with the other half of said one end sheared substantially perpendicular to said longitudinal dimension, the adjoining ends of said side leg and yoke laminations in each of said layers being substantially aligned to form joints therebetween wherein said one end of said side leg and yoke laminations form half straight and half diagonal joints, the corresponding ends of successive layers of said side leg and yoke laminations arranged in step relation to one another about the outer corners of said core, the ends of said side leg and yoke laminations in one layer overlapping the ends of said side leg and yoke laminations in the next adjacent layer to present a step-lap joint joining the ends of said side leg and yoke laminations.

2. The magnetic core of claim 1 wherein said side leg and yoke laminations are assembled around a substantially rectangular window.

3. The magnetic core of claim 1 wherein said side leg and yoke laminations are assembled around a substantially square window.

4. The magnetic core of claim 1 wherein said strip material has a preferred direction of orientation lengthwise thereof.

5. The magnetic core of claim 1 wherein said strip material is made of amorphous strip material.

6. The magnetic core of claim 1 wherein said strip material is unoriented.

7. The magnetic core of claim 1 wherein said step-lap joint comprises at least three layers of said side leg and yoke laminations.

8. The magentic core of claim 1 wherein the extent of the overlapping of the ends of said side leg and yoke laminations in one layer by the corresponding ends of said side leg and yoke laminations in the next adjacent layer is at least six times the thickness of said side leg and yoke laminations.

9. The magentic core of claim 1 wherein said side leg and yoke laminations are of two shapes, a first substantially rectangular-shaped member having a half of one end thereof cut diagonally with respect to the longitudinal dimension of said first member with the other half of said one end cut substantially perpendicular to said longitudinal dimension, the opposite end of said first member being cut substantially perpendicular to said longitudinal dimension, and a second substantially rectangular-shaped member having a half of one end thereof cut diagonally with respect to the longitudinal dimension of said second member with the other half of said one end cut substantially perpendicular to said longitudinal dimension, the opposite end of said second member being cut substantially diagonally with respect to said longitudinal dimension.

10. The magnetic core of claim 1 wherein said layers are divided into groups each including eight layers.

11. A stacked magentic core comprising:

a plurality of layers of laminations formed from a magnetic strip material, each of said layers including at least two side leg and two yoke laminations assembled around a core window forming four substantially squared outer corners, each of said side leg and yoke laminations having a half of one end thereof cut diagonally with respect to the longitudinal dimension of said strip material with the other half of said one end cut substantially perpendicular to the longitudinal dimension of said strip material, the opposite end of each of said side leg and yoke laminations cut diagonally or substantially perpendicular with respect to the longitudinal dimension of said strip material, the adjoining ends of said side leg and yoke laminations in each of said layers being substantially aligned to form joints therebetween wherein said one ends of said side leg and yoke laminations form half straight and half diagonal joints with said opposite ends of said side leg and yoke laminations forming straight or diagonal joints, the corresponding ends of successive layers of said side leg and yoke laminations arranged in step relation to form a step pattern at the outer corners of said core, the ends of said side leg and yoke laminations in one layer overlapping the ends of said side leg and yoke laminations in the next adjacent layer to present a step-lap joint joining the ends of said side leg and yoke laminations.

12. A stacked magnetic core comprising:

a plurality of layers of laminations formed from a magnetic strip material, each of said layers including at least two yoke laminations and two side leg laminations assembled around a core window and forming four substantially squared outer corners, each of said leg and yoke laminations having a half of one end thereof cut diagonally with respect to the sides of said strip material with the other half of said one end cut at substantially a right angle with respect to the sides of said strip material, the adjoining ends of said leg and yoke laminations in each of said layers being substantially aligned to form joints therebetween wherein said one end of said leg and yoke laminations form a half straight and half diagonal joint between said side leg and yoke laminations on diagonally opposed sides of said core window, the other end of said side leg and yoke laminations forming a straight or diagonally cut joint, said half straight and half diagonal joints being shifted 90° in successive layers of said side leg and yoke laminations, the corresponding ends of successive layers of said side leg and yoke laminations being arranged in step relation to form a step pattern about the outer corners of said core, the ends of said side leg and yoke laminations overlapping the joints between the ends of said side leg and yoke laminations in adjacent layers.

13. The magnetic core of claim 12 wherein said side leg and yoke laminations are assembled around a substantially rectangular core window.

14. The magnetic core of claim 12 wherein said side leg and yoke laminations are assembled around a substantially square core window.

15. The magnetic core of claim 12 wherein said strip material has a preferred direction of orientation lengthwise thereof.

16. The magnetic core of claim 12 wherein said strip material is made of amorphous strip material.

17. The magnetic core of claim 12 wherein said strip material is unoriented.

18. The magnetic core of claim 12 wherein the extent of the overlapping of the joints between the ends of said side leg and yoke laminations by the ends of said side leg and yoke laminations in the adjacent layers is at least six times the thickness of said laminations.

19. The magnetic core of claim 12 wherein said layers are divided into groups each including eight layers.

20. A stacked magnetic core comprising:

a plurality of layers of laminations formed from a magnetic strip material, each of said layers including at least two side leg and two yoke laminations and one center leg lamination assembled around two core windows forming four outer corners, each of said side leg and yoke laminations having a half of one end thereof sheared diagonally with respect to the longitudinal dimension of said strip material with the other half of said one end sheared substantially perpendicular to said longitudinal dimension, said center leg lamination having one end sheared in substantially the shape of a right triangle and the other end sheared in substantially a square shape, said yoke laminations including recesses configured to receive the ends of said center leg lamination, the adjoining ends of said side leg and yoke laminations in each of said layers being substantially aligned to form joints therebetween wherein said one ends of said side leg and yoke laminations form half straight and half diagonal joints, the corresponding ends of successive layers of said side leg and yoke laminations arranged in step relation to form a step pattern about the outer corners of said core, the ends of said side leg and yoke laminations overlapping the joints between the ends of said laminations in adjacent layers.

21. The magnetic core of claim 20 wherein said center leg lamination has one end sheared substantially in the shape of a right triangle and the other end sheared substantially in the shape of an opposed right triangle.

22. The magnetic core of claim 20 wherein said center leg lamination has each end sheared substantially in a V-shape.

23. A stacked magnetic core comprising:

a plurality of layers of laminations formed from a magnetic strip material, each of said layers including at least two yoke laminations and two outer and one inner leg laminations assembled around two core windows and forming four substantially squared outer corners, said inner leg lamination having one end cut in substantially the shape of a right triangle and the other end cut in substantially a square shape, said yoke laminations including recesses configured to receive the ends of said inner leg lamination, each of said outer leg and yoke laminations having a half of one end thereof cut diagonally with respect to the longitudinal dimension of said strip material with the other half of said one end cut substantially perpendicular to the longitudinal dimension of said strip material, the other end of said outer leg and yoke laminations being cut substantially perpendicular or diagonally with respect to the longitudinal dimension of said strip material, the adjoining ends of said leg and yoke laminations in each of said layers being substantially aligned to form joints therebetween wherein said one ends of said outer leg and yoke laminations form a half straight and half diagonal joint between respective yoke and outer leg laminations on diagonally opposed sides of said core window, the other end of said outer leg and yoke laminations forming a straight or diagonally cut joint, said half straight and half diagonal joints being shifted 90° in successive layers of said outer leg and yoke laminations, the corresponding ends of successive layers of said outer leg and yoke laminations being arranged in step relation to form a step pattern at the outer corners of said core, the ends of said leg and yoke laminations overlapping the joints between the ends of said leg and yoke laminations in adjacent layers.

24. The magnetic core of claim 23 wherein said inner leg lamination has one end sheared substantially in the shape of a right triangle and the other end sheared substantially in the shape of an opposed right triangle.

25. The magnetic core of claim 23 wherein said inner lamination has each end sheared substantially in a V-shape.

26. The magnetic core of claim 23 wherein said laminations are assembled around a substantially rectangular core window.

27. The magnetic core of claim 23 wherein said laminations are assembled around a substantially square core window.

28. The magnetic core of claim 23 wherein said strip material has a preferred direction of orientation lengthwise thereof.

29. The magnetic core of claim 22 wherein said strip material is made of amorphous strip material.

30. The magnetic core of claim 23 wherein said strip material is unoriented.

31. The magnetic core of claim 23 wherein said layers are divided into groups each including eight layers.

32. A method of making a stacked magnetic core, comprising:

shearing one end of each of at least four laminations formed from a magnetic strip material so that said one end has a half thereof sheared diagonally with respect to the longitudinal dimension of the strip material with the other half of said one end sheared substantially perpendicular to said longitudinal dimension;

assembling said laminations around a core window to form a plurality of layers of laminations, each of said layers including at least two side leg and two yoke laminations;

aligning the adjoining ends of said side leg and yoke laminations to form joints therebetween wherein said one end of said leg and yoke laminations form half straight and half diagonal joints;

arranging the corresponding ends of successive layers of said side leg and yoke laminations in step relation to one another; and overlapping the ends of said side leg and yoke laminations in one layer with the ends of said side leg and yoke laminations in the next adjacent layer to present a step-lap joint joining the ends of said side leg and yoke laminations.

33. The method of claim 32 wherein said laminations are assembled around a substantially rectangular core window.

34. The method of claim 32 wherein said laminations are assembled around a substantially square core window.

35. The method of claim 32 wherein the strip material has a preferred direction of orientation lengthwise thereof.

36. The method of claim 32 wherein the strip material is made of amorphous strip material.

37. The method of claim 32 wherein the strip material is unoriented.

38. The method of claim 32 wherein said layers are divided into groups each including eight layers.

* * * * *

UNITED STATES PATENT AND TRADEMARK OFFICE

CERTIFICATE OF CORRECTION

PATENT NO. : 4,445,104

DATED : April 24, 1984

INVENTOR(S) : Kou C. Lin and Charles E. Burkhardt

It is certified that error appears in the above-identified patent and that said Letters Patent are hereby corrected as shown below:

Column 4, line 53, delete "31" and substitute therefor --32--.

Column 4, line 54, delete "52", first occurrence thereof, and substitute therefor --51--.

Column 4, line 55, delete "32" and substitute therefor --31--.

Column 6, line 20, delete "the".

Column 6, line 53, delete "is" (2nd occurr.) and substitute therefor --in--.

Column 7, line 9, delete "the", first occurrence thereof.

UNITED STATES PATENT AND TRADEMARK OFFICE

CERTIFICATE OF CORRECTION

PATENT NO. : 4,445,104

DATED : April 24, 1984

INVENTOR(S) : Kou C. Lin and Charles E. Burkhardt

It is certified that error appears in the above-identified patent and that said Letters Patent are hereby corrected as shown below:

Column 8, line 17, delete "magentic" and substitute therefor --magnetic--.

Signed and Sealed this

*Nineteenth* Day of *February 1985*

[SEAL]

*Attest:*

DONALD J. QUIGG

*Attesting Officer* *Acting Commissioner of Patents and Trademarks*